US008951942B2

(12) United States Patent
Pick et al.

(10) Patent No.: US 8,951,942 B2
(45) Date of Patent: Feb. 10, 2015

(54) METHOD OF MAKING CARBON NANOTUBE DISPERSIONS FOR THE ENHANCEMENT OF THE PROPERTIES OF FLUIDS

(76) Inventors: Martin Pick, High Melton (GB); Krzysztof Kazimiers Koziol, Cambridge (GB); Alan Hardwick Windle, Cambridge (GB)

( * ) Notice: Subject to any disclaimer, the term of this patent is extended or adjusted under 35 U.S.C. 154(b) by 668 days.

(21) Appl. No.: 13/000,289

(22) PCT Filed: Jun. 19, 2009

(86) PCT No.: PCT/GB2009/001557
§ 371 (c)(1),
(2), (4) Date: May 19, 2011

(87) PCT Pub. No.: WO2009/153576
PCT Pub. Date: Dec. 23, 2009

(65) Prior Publication Data

US 2011/0224113 A1 Sep. 15, 2011

(30) Foreign Application Priority Data

Jun. 20, 2008 (GB) ..... 0811357.3

(51) Int. Cl.
*C10M 125/02* (2006.01)
*C10M 113/02* (2006.01)
*C10M 111/04* (2006.01)
(Continued)

(52) U.S. Cl.
CPC ..... *C10M 171/06* (2013.01); *C10M 113/02* (2013.01); *C10M 125/02* (2013.01); *C10M 177/00* (2013.01); *C10M 2201/02* (2013.01); *C10M 2201/041* (2013.01); *C10M 2201/0416* (2013.01); *C10M 2203/1006* (2013.01); *C10M 2205/0285* (2013.01); *C10M 2219/044* (2013.01); *C10M 2229/025* (2013.01); *C10N 2220/08* (2013.01); *C10N 2220/082* (2013.01); *C10N 2220/084* (2013.01); *C10N 2220/086* (2013.01); *C10N 2230/02* (2013.01); *C10N 2230/06* (2013.01); *C10N 2230/68* (2013.01); *C10N 2240/04* (2013.01); *C10N 2240/042* (2013.01); *C10N 2240/044* (2013.01);
(Continued)

(58) Field of Classification Search
USPC ..... 508/116, 113, 131, 126, 130, 128; 977/742
See application file for complete search history.

(56) References Cited

U.S. PATENT DOCUMENTS 6,432,320 B1 8/2002 Bonsignore et al.
6,783,746 B1 8/2004 Zhang et al.
(Continued)

FOREIGN PATENT DOCUMENTS

WO 2007/103497 9/2007

OTHER PUBLICATIONS

PCT Search Report dated Apr. 11, 2009 for PCT/GB2009/001557.
PCT Report on Patentability dated Dec. 21, 2010 for PCT//GB2009/001557.
Abstract of Lu et al, "Synthesis and lubricating performance of a carbon nanotube seeded miniemulsion" Carbon, Elseviwe, Oxford, GB, vol. 45, No. 5, Apr. 6, 2001 pp. 936-942 (Abstract only).

*Primary Examiner* — Vishal Vasisth
(74) *Attorney, Agent, or Firm* — Factor Intellectual Property Law Group, Ltd.

(57) ABSTRACT

A method for the preparation of carbon nanotube modified fluids such, that the dispersion of nanotubes in such fluids, exampled by those which are oil based is enhanced through the combined use of mechanical, sonic and ultrasonic devices.

37 Claims, 3 Drawing Sheets

Figure 1:
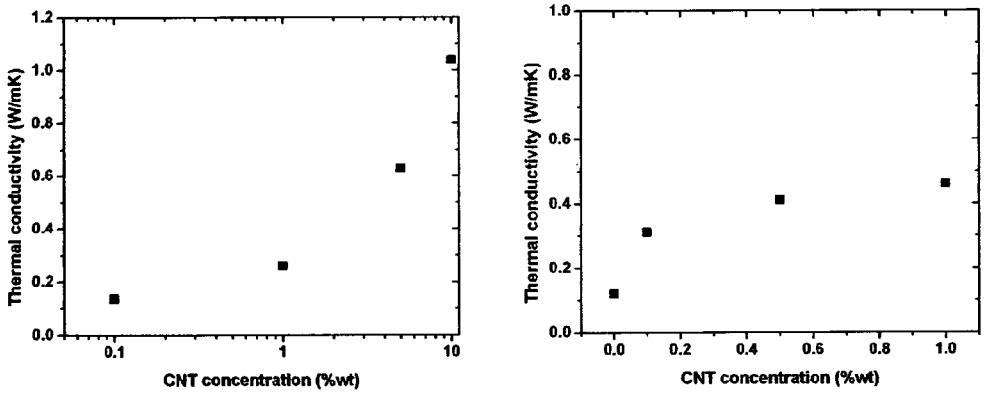

(51) Int. Cl.
*C10M 171/06* (2006.01)
*C10M 177/00* (2006.01)

(52) U.S. Cl.
CPC ..... *C10N2240/046* (2013.01); *C10N 2240/08* (2013.01); *C10N 2240/10* (2013.01); *C10N 2250/10* (2013.01); *C10N 2260/00* (2013.01); *C10N 2260/06* (2013.01); *C10N 2260/09* (2013.01); *C10N 2260/12* (2013.01); *Y10S 977/742* (2013.01)
USPC ..... 508/116; 508/113; 508/126; 508/128; 508/130; 508/131; 977/742

(56) References Cited

U.S. PATENT DOCUMENTS

| | | | | |
|---|---|---|---|---|
| 6,828,282 | B2 | 12/2004 | Moy et al. | |
| 2001/0041663 | A1 | 11/2001 | Moy et al. | |
| 2003/0158323 | A1 | 8/2003 | Connell et al. | |
| 2006/0040832 | A1 | 2/2006 | Zhang et al. | |
| 2006/0099135 | A1 | 5/2006 | Yodh et al. | |
| 2007/0142548 | A1 * | 6/2007 | Nejhad et al. | 524/847 |
| 2007/0199729 | A1 * | 8/2007 | Siegel et al. | 174/73.1 |
| 2007/0293405 | A1 * | 12/2007 | Zhang et al. | 508/113 |

* cited by examiner

Table 1 Decrease of wear (based on the ball test method) by the addition of carbon nanotubes to the fluid.

| Sample | Wear (%) |
|---|---|
| Polyalphaolefin | 3.3 |
| Polyalphaolefin + ZnTTP | 2.6 |
| Polyalphaolefin + 0.1% CNTs | 1.1 |
| Polyalphaolefin + 0.5% CNTs | 0.3 |

Fig. 3.

METHOD OF MAKING CARBON NANOTUBE DISPERSIONS FOR THE ENHANCEMENT OF THE PROPERTIES OF FLUIDS

RELATED APPLICATIONS

This application claims the filing benefit of International Patent Application No. PCT/GB2009/001557, filed Jun. 19, 2009, which claims the filing benefit of British Patent Application No. 0811357.3 filed Jun. 20, 2008, the contents of both which are incorporated herein by reference.

BACKGROUND OF THE INVENTION

With the global reliance on technologies containing fluids for their effective operation it is the case that the quality and technical specification of such fluids be maximised as and when new techniques and materials become available.

There is always an automotive industry requirement for reduced friction for lubricating oils, over broad temperature and torque ranges. Mineral oils are very effective at low temperatures but as the temperature rises their film forming ability diminishes due to a drop in viscosity which impairs the hydrodynamic lubrication regime.

Lubricants also function as a coolant, particularly under high torque conditions. Water is usually the preferred choice for heat removal because of its high thermal conductivity but it is generally unsuitable for use as a lubricant. Gear train lubricants are made primarily from hydrocarbons that have a much lower thermal conductivity and heat capacity than water. Typical gear lubricant base oils include mineral oil, polyalphaolefm, ester synthetic oil, ethylene oxide/propylene oxide synthetic oil, polyalkylene glycol synthetic oil etc. The typical thermal conductivity of these formulations is 0.12 to 0.16 W/m-K at room temperature and they are most effective between 0.12 to 0.14 W/m-K. Water is rated at 0.61 W/m-K.

Synthetic lubricating oils include hydrocarbon oils and halo-substituted hydrocarbon oils such as polymerized and interpolymerized olefins (e.g., polybutylenes, polypropylenes, propylene-isobutylene copolymers, chlorinated polybutylenes, poly(1-octenes), poly(1-decenes), etc., and mixtures thereof; alkylbenzenes (e.g., dodecylbenzenes, tetradecylbenzenes, dinonylbenzenes, di-(2-ethylhexyl)benzenes, etc.); polyphenyls (e.g., biphenyls, terphenyls, alkylated polyphenyls, etc.), alkylated diphenyl, ethers and alkylated diphenyl sulfides and the derivatives, analogs and homologs thereof and the like. Alkylene oxide polymers and interpolymers and derivatives thereof where the terminal hydroxyl groups have been modified by esterification, etherification, etc. constitute another class of known synthetic oils.

Another class of synthetic oils comprises the esters of dicarboxylic acids (e.g., phtalic acid, succinic acid, alkyl succinic acids and alkenyl succinic acids, maleic acid, azelaic acid, suberic acid, sebacic acid, fumaric acid, adipic acid, alkenyl malonic acids, etc.) with a variety of alcohols (e.g., butyl alcohol, hexyl alcohol, dodecyl alcohol, 2-ethylhexyl alcohol, ethylene glycol diethylene glycol monoether, propylene glycol, etc.). Specific examples of these esters include dibutyl adipate, di(2-ethylhexyl) sebacate, di-hexyl fumarate, dioctyl sebacate, diisooctyl azelate, diisodecyl azealate, dioctyl phthalate, didecyl phthalate, dicicosyl sebacate, the 2-ethylhexyl diester of linoleic acid dimer.

Esters useful as synthetic oils also include those made from $C_5$ to $C_{,2}$ monocarboxylic acids and polyols and polyol ethers such as neopentyl glycol, trimethylolpropane, pentaerythritol, dipentaerythritol, tripentaerythritol, etc. Other synthetic oils include liquid esters of phosphorus-containing acids (e.g., tricresyl phosphate, trioctyl phosphate, diethyl ester of decylphosphonic acid, etc.), polymeric tetrahydrofurans and the like Polyalphaolefins (PAO) include those sold by Mobil Chemical Company and those sold by Ethyl Corporation however the described invention is not restricted to the products of these companies.

It is in the domain of lubricant improvement that the described invention exists.

FIELD OF THE INVENTION

Metal particles such as copper, silver, gold, etc., can be used to enhance lubricant performance but are generally less effective than carbon. Known solid lubricants such as molybdenum disulfide, boric acid, boron nitride, etc. can also be milled to nanosize and used to achieve some viscous thickening, but are minimally effective in increasing thermal conductivity. Abrasive particles such as aluminum oxide and many types of carbides, e.g. silicon carbide may be excluded due to high friction or wear in some scenarios, but do impart some improvement in viscosity index and thermal conductivity.

The described invention relates to carbon nanostructures, which when dispersed in a host lubricating fluid alters its operating characteristics, exampled by viscosity, thermal conductivity and electrical conductivity.

An allotrope of carbon that resides under the collective title of Carbon Nanotubes has been identified as a major ingredient to improve the performance of lubricating fluids.

The aforementioned automotive industry requirement for lubricating fluids with reduced friction over broad temperature and torque ranges is constant. It is met by the dispersion of carbon nanotubes in lubricating products. The addition of suitably dispersed carbon nanotubes in lubricating fluids increases their operating range.

It is understood that the term carbon nanotubes when used in the following description alludes to carbon nanostructures such as nanotubes, nanofibrils, nanoparticles and another types of graphitic structure useful in the present invention, provided that the shape of the majority of the particles should allow for partial or full alignment in flow fields at high shear rates $>10^5\ s^{-1}$. They should have certain degree of asymmetry, and the aspect ratio of the particles should be small enough to prevent excessive permanent viscosity loss in shear fields. It is also understood that the nanostructures used for the purposes outlined in the description are free from contaminating carbon normally referred to as pyrolytically deposited carbon.

FUNCTION OF THE INVENTION

It is the function of the described invention to enhance the operating characteristics of fluids used as lubricants. The operating limits of such lubricants can be extended for viscosity, thermal conductivity and electrical conductivity amongst others. It is well known that in many cases dispersions based on particulates e.g. graphite, carbon black and carbon nanotubes where the particulate often exist as agglomerate/flocculate has a settling tendency in the fluid which can "pile up" in restricted flow areas in concentrated contacts, thereby leading to lubricant starvation. The present invention addresses this problem and disperses carbon nanotube structures throughout the aforementioned fluid lubricants such that they do not precipitate or 'pile up' at resistricted flow areas. Lubricant starvation is therefore minimised or illiminated.

Improvements povided by the described invention over prior art are identified in the embodiment of the invention.

There are various types of processes used to disperse nanoparticles in the liquid phase. These can involve functionalisation of the nanoparticles to increase their compatibility with the dispersion media (liquid or gas), use of a surfactant phase, pre mixing or use of mechanical energy. This invention refers specifically to the novel use of mechanical energy to disperse carbon nanotubes. This can however be used in combination with other techniques or on its own.

Commonly, techniques using mechanical energy to disperse nanoparticles, as exampled by carbon nanotubes, rely on the use of shear induced energy or ultrasonic induced energy.

Shear induced energy through the use of high-pressure homogenisers or shear mixers is exampled by a Silverson LM4 high shear mixer. Induced mechanical energy in the form of ultrasonic or any other high frequency induced vibration is exampled by the use of a Decon FS200b ultrasonic bath or MISONIX probe.

The present invention describes a method by which an ideal dispersion is produced. It relates to the use of a combination of methods to induce mechanical energy. It is found that by using a combination of methods the ease of dispersion and the degree of dispersion are significantly improved. In a preferred embodiment of the invention a combination of shear mixing and ultrasonication is used.

The viscosity of the dispersion can change depending on the loading fraction of carbon nanotubes. In the case of oil the viscosity increases by 60% at 0.2 wt % of nanotube loading fraction however this increase will vary depending on the type of oil system used, additives and quality of dispersion achieved.

In the case of aqueous systems the viscosity will increase by 30% at 1 wt % nanotube loading fraction. Here the quality of dispersion has a significant effect on the viscosity changes. Poor dispersion will increase viscosity substantially which will not be beneficial to heat removal and presence of agglomerates or carbon nanotube bundles will not be beneficial to the enhancement of lubrication.

Above 2 wt % a liquid crystalline phase can be formed however the formation of this phase is very much dependent on the quality and type of dispersion. Also the aspect ratio of carbon nanotubes will influence the formation of liquid crystalline phase. In the liquid crystalline phase the viscosity of the dispersion will decrease (as compared to isotropic system) due to alignment of nanotubes which is important in the heat removal function of the fluid. Furthermore due to the better alignment of nanotubes the lubrication will be further enhanced.

A grease-type material can be obtained using the present invention with nanotube loading of 1 wt % and above, however improvement in the lubrication can be achieved also be achieved at carbon nanotube loadings as low as 0.1 wt % (Table 1).

The current invention relates to a novel use of nanomaterials as a viscosity modifier and thermal conductivity improver for water based systems, oil based systems, fuel based systems, grease based systems, glue based systems, other lubricating systems and/or mixture of the mantioned. The fluids have a higher viscosity index, higher shear stability, improved thermal conductivity, a reduction in the coefficient of friction, including reduced friction in the boundary lubrication regime compared to currently available oils.

PRIOR ART

U.S. Pat. No. 6,432,320 Bonsignore et al, provisional application filed 22 Nov. 2000 demonstrates that nano-powders such as copper, iron, alloys, etc., and carbon, can be combined with heat transfer liquids and a coating on the powder to form a colloidal dispersion with enhanced heat transfer properties. However there are numerous instances of these particles either not providing significant heat transfer benefit or being completely unacceptable for oils due to performance in viscosity or boundary lubrication control.

U.S. Pat. No. 6,828,282 Moy et al, provisional application filed Mar. 17, 2000 indicates that carbon nanotubes will increase the lubricant properties of lubricant oils. It is unclear however how this lubricant/nanotube combination is produced. Without details of the dispersion method there is no guarantee that the dispersed carbon nanostructures will remain effective in use.

Attention is brought to the publications 'Fabrication and Characterization of Carbon Nanotubes/Polyvinyl alcohol Composites' advanced Materials 11, (11) 937 1999; Shaffer M. S., Fan X. and Windle A. H. Windle A. H. et al 'Dispersion and Packaging of Carbon Nanotubes' 36 (11) 1603 1999; Windle A. H. et al 'Development of a Dispersion Process for Carbon Nanotubes in an Epoxy Matrix and the resulting Electrical Properties'; Polymer 40 5967 1999. The above publications give details on carbon fibrils used to increase the viscosity of liquids.

Embodiment Of The Invention

According to the described invention there is provided a method of dispersing nanostructures as previously described in lubricating oil such that its properties are enhanced. Enhancement is exampled by an improvement in viscosity, thermal conductivity and electrical conductivity.

The shape of the aforementioned carbon nanotube structures should allow for partial or full alignment in flow fields at high shear rates $>10^5\ s^{-1}$. They should have a certain degree of asymmetry and the aspect ratio of the particles should be small enough to prevent excessive permanent viscosity loss in shear fields.

Carbon nanotubes as previously identified can be used together with the nanotube structure referred to as herringbone and cupstacked which have either conical or cylindrical walls as can doped nanotubes with boron, nitrogen or other hetroatomic species. The surface of the nanotubes can be modified with chemistries using carboxylate, ester, amine, amide, imine, imide, hydroxyl, ether, epoxide, phosphorus, ester carboxyl, anhydried or nitrile. A two or more component matrix can be used together with carbon nanotubes to act as an surfactant to be positioned between the interfaces. If required the main matrix of the dispersion can be oil base exampled by poly α-olefins, silicon oil together with a water base and/or alcohol, an ether, a ketone, an ester, an amide, a sulfoxide, a hydrocarbon, petrol, diesel or a miscible mixture thereof.

The dispersion of carbon nanotubes in an oil based fluid is achieved through the combined use of mechanical and sonic/untrasonic devices. In this way a homogeneous dispersion is achieved such that each and every nanotube is separated from one another by at least one layer, one molecule, of the dispersing matrix. Due to the aspect ratio fractions of the individual carbon nanotubes the surfaces can be in contact with each other allowing the formation of a percolating network. A perfect dispersion means no agglomerates and no bundles.

Oil

The typical preparation time for dispersion is 3 hours however this time may vary depending on the viscosity of the fluid and the temperature at which the dispersion is obtained. Carbon nanotubes and a matrix, exampled by oil, are placed in a suitable vessel. The high shear mixing head is used to provide mechanical mixing. The ultrasonic probe and/or ultrasonic bath are used to deliver the sound energy while mechanically mixing.

During this process the vessel stands on a rotating table which ensures uniform and complete mixing of the whole volume of the matrix and all potential dead-corners.

A slight increase in temperature exampled by 60 degrees centigrade provides enhancement of the dispersion quality.

Aqueous

The mixing process is as that described for oil but 2 wt % of a surfactant is added to water to achieve high carbon nanotube loading. Very good dispersions are indicated by very little increase of viscosity. The use of a glycol or oil mix allows the nanotubes to disperse and sit at the interface between the two types of molecules. In the case of water a glycol or oil mix can be used with nanotubes. With this approach the nanotubes disperse and sit in the interface.

In order to avoid a significant increase in the viscosity of the fluid a dodecylbenzene based surfactant can be used.

Fuel and Volatile Fluids.

The mixing process is as that described for oil. It was found beneficial to use lower aspect ratio CNTs and decrease the temperature during fluid preparation.

FIGURES

A further description of the present invention will be given with reference to the following figures.

FIG. 1. Shows two graphs plotting carbon nanotube concentrations against the increase in thermal conductivity.

Figure 2:
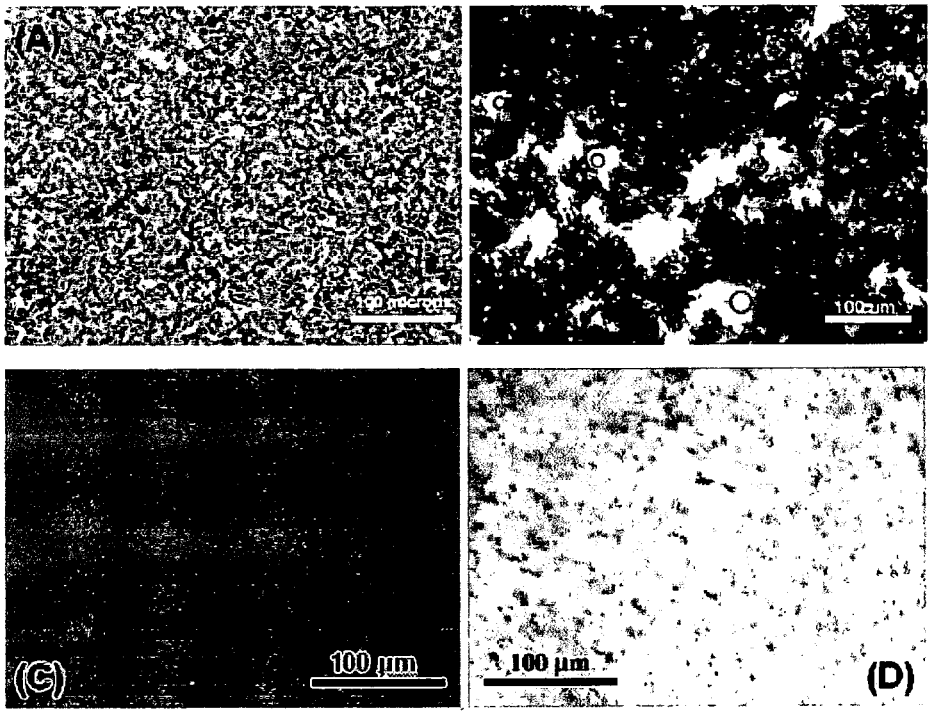

FIG. 2. Shows two optical microscopy images of poorly formed dispersions by mixing or sonication and two optical microscopy images of molecular-type dispersions with the difference in nanotube aspect ratios. All dispersions prepared at 1% wt loading of carbon nanotubes.

FIG. 3. Shows a table giving the decrease in wear when carbon nanotubes are dispersed in a lubricating fluid.

With reference to FIG. 1.

The graphs show the increase in thermal conductivity plotted against the increase in carbon nanotube concentration for different lubricating fluids.

With reference to FIG. 2.

A. Shows dispersion by sonication only. There are visible small particulates/agglomerates on the micron scale. This dispersion act as spherical dispersion e.g. of metal particles.

B. Shows dispersion with just mechanical mixing. There are some good areas but mostly agglomerates on different scale lengths.

C. Shows perfect molecular-type dispersion with sonic/mechanical mixing for nanotubes of aspect ratio 200.

D. Shows perfect molecular-type dispersion with sonic/mechanical mixing for nanotubes of aspect ratio 2000.

With reference to FIG. 3.

Table I.

Shows the decrease in wear, based on the ball test method, by the addition of carbon nanotubes to the fluid.

The invention claimed is:

1. A method of dispersing nanostructures in a containing matrix comprising the steps of:

mixing a containing matrix including nanostructures;

applying a high shear mechanical mixing to the mixture;

applying an ultrasonic mixing to the mixture, wherein the high shear mechanical mixing is applied synchronously with the ultrasonic mixing; and, producing an agglomerate free dispersion of nanostructures within the mixture.

2. The method of claim 1 wherein the nanostructures are carbon nanotubes.

3. The method of claim 1 wherein the nanostructures are nanofibers.

4. The method of claim 2 wherein a weight fraction of carbon nanotubes present in a liquid crystalline region is between 2 wt % to 30 wt % based on a total weight of a dispersion.

5. The method of claim 3 wherein a weight fraction of nanofibers present in a liquid crystalline region is between 2 wt % to 30 wt % based on a total weight of the dispersion.

6. The method of claim 2 wherein the weight fraction of carbon nanotubes present is an isotropic mix in a region of 0.001 wt % to 30 wt % of nanostructures based on the total weight of a dispersion.

7. The method of claim 3 wherein the weight fraction nanofibers present is an isotropic mix in a region of 0.001 wt % to 30 wt % of nanostructures based on the total weight of the dispersion.

8. The method of claim 2 wherein the carbon nanotubes are different types with heteroatomic doping.

9. The method of claim 3 wherein the nanofibers are different types with heteroatomic doping.

10. The method of claim 2 wherein the carbon nanotubes are surface modified.

11. The method of claim 3 wherein the nanofibers are surface modified.

12. The method of claim 2 wherein the carbon nanotubes are modified with a chemistry selected from the group consisting of: carboxylate, ester, amine, amide, imine, imide, hydroxyl, ether, epoxide, phosphorus, ester carboxyl, anhydride, and nitrile.

13. The method of claim 2 wherein two or more carbon nanotubes act as a surfactant and are positioned between interfaces.

14. The method of claim 3 wherein two or more component nanofibers act as a surfactant and are positioned between a interfaces.

15. The method of claim 1 wherein the containing matrix of the dispersion is oil based.

16. The method of claim 1 wherein the containing matrix is aqueous.

17. The method of claim 15 wherein the oil base is selected from the group consisting of: a poly α-olefin, silicone oil with a water base and/or other type alcohol, an ether, a ketone, an ester, an amide, a sulfoxide, a sulfoxide, a hydrocarbon, petrol, diesel and a miscible mixture thereof.

18. The method of claim 15 wherein the oil based containing matrix comprises a base-oil and oil soluble additives.

19. The method of claim 18 wherein the base-oil is selected from the group consisting of: mineral base oils, synthetic base oils, and base oils derived from biological materials.

20. The method of claim 1 further comprising the step of: adding a surfactant.

21. The method of claim 20 wherein the surfactant includes a mixture of non-ionic and ionic surfactants.

22. The method of claim 20 wherein the surfactant includes an ashless polymeric surfactant.

23. The method of claim 1 wherein the containing matrix is a monomer.

24. The method of claim 20 wherein the surfactant is dodecylbenzene sulfonic acid or sodium salt thereof.

25. The method of claim 2 wherein the carbon nanotubes have a mean diameter between 0.6 and 200 nanometers.

26. The method of claim 3 wherein the nanofibers have a mean diameter between 0.6 and 200 nanometers.

27. The method of claim 2 wherein the carbon nanotubes have a length of 100 nanometers to 1000 microns.

28. The method of claim 3 wherein the nanofibers have a length of 100 nanometers to 1000 microns.

29. The method of claim 2 wherein the carbon nanotubes have a ratio of length to diameter of 10 to 100000.

30. The method of claim 3 where the nanofibers have a ratio of length to diameter of 10 to 100000.

31. The method of claim 1 further comprising the steps of:
adding an additional dispersant to the mixture; and,
re-mixing the mixture.

32. The method of claim 1 wherein the containing matrix is in a form as a gel or a paste obtained from a liquid petroleum liquid or an aqueous medium.

33. The method of claim 1 wherein the dispersion of nanostructures is uniform.

34. The method of claim 33 wherein the containing matrix is in the form of a grease.

35. The method of claim 20 wherein the surfactant is selected from the group consisting of: an ionic surfactant and, a mixture of nonionic and ionic surfactants.

36. The method of claim 25 wherein a weight fraction of carbon nanotubes present is an isotropic mix in a region of 0.001 wt % to 30 wt % of nanostructures based on a total weight of the dispersion.

37. The method of claim 29 wherein a weight fraction of nanofibers present is an isotropic mix in a region of 0.001 wt % to 30 wt % of nanostructures based on a total weight of the dispersion.

* * * * *